US005163549A

United States Patent [19]

Hayduchok

[11] Patent Number: 5,163,549

[45] Date of Patent: Nov. 17, 1992

[54] POCKET CONTAINER AND STAND FOR WRITING IMPLEMENTS

[76] Inventor: Leon Hayduchok, 15 Sandy La., Trenton, N.J. 08610

[21] Appl. No.: 782,655

[22] Filed: Oct. 25, 1991

[51] Int. Cl.[5] ..... B65D 85/28

[52] U.S. Cl. ..... 206/214; 206/224; 206/371; 206/443; 220/23.4

[58] Field of Search ..... 206/214, 224, 371, 443, 206/37, 38; 220/23.4

[56] References Cited

U.S. PATENT DOCUMENTS

| | | | |
|---|---|---|---|
| 3,857,482 | 12/1974 | Shelton | 220/23.4 |
| 4,304,330 | 12/1981 | Winkler et al. | 206/214 |
| 4,406,368 | 9/1983 | Hermes | 206/214 |
| 4,562,923 | 1/1986 | Katada et al. | 206/214 |
| 4,570,793 | 2/1986 | O'Neil et al. | 206/214 |
| 4,666,043 | 5/1987 | Tahara | 206/37 |
| 4,773,544 | 9/1988 | McCarthy | 206/214 |
| 4,798,310 | 1/1989 | Kasai | 206/224 |
| 4,941,576 | 7/1990 | Sugarman et al. | 206/214 |
| 4,972,947 | 11/1990 | McCarthy | 206/214 |

FOREIGN PATENT DOCUMENTS

| | | | |
|---|---|---|---|
| 0256719 | 2/1988 | European Pat. Off. | 206/214 |
| 0274991 | 7/1988 | European Pat. Off. | 206/214 |
| 2534861 | 11/1976 | Fed. Rep. of Germany | 206/443 |
| 3617214 | 11/1987 | Fed. Rep. of Germany | 206/214 |

*Primary Examiner*—Jimmy G. Foster

*Attorney, Agent, or Firm*—Mathews, Woodbridge & Collins

[57] ABSTRACT

A caddy of generally modular form for writing implements is designed with a plurality of sockets to receive and support writing implements in upright position, with the writing ends secured in closed position with the receiving socket. In one embodiment, the caddy accommodates a plurality of conventional marking pens together with their individual caps, which caps remain captive when the pens are removed. In another embodiment the caps are initially incorporated in the sockets, which serve as caps for the interposed writing implements. In a further modification the caddies are combined with standards comprising a series of modules having U-shaped attachments on their rear bases which are designed to hook onto one or more additional modules, so that several caddies may be stacked together in aligned relation on a supporting surface for accommodating a variety of writing implements. In another modification, a patch of a self-gripping fastening material known by the trademark VELCRO, or the like, may be attached to the surface of the caddy, so that the latter may be removed from a desk or other supporting surface and secured in a notebook or carrying case.

8 Claims, 6 Drawing Sheets

POCKET CONTAINER AND STAND FOR WRITING IMPLEMENTS

BACKGROUND OF THE INVENTION

This relates in general to containers for writing implements, and more particularly, to a pocket device constructed to serve as a receptacle, multiple cap, and table stand for supporting writing implements in a position accessible to the user.

There have been numerous pen/pencil carrying and display cases in the prior art; but none combines a convenient carrying case with a device which is adapted to perform the multiple functions of providing a receptacle which serves to cap the enclosed writing implements, and which is adapted, when capped, to be carried in the pocket or purse, notebook or carrying case and otherwise, provides a support resting on a flat surface for holding the writing implements in a position accessible to the user and safe for children.

A particular disadvantage of prior-type supports for writing implements is that they are designed to loosely engage the writing implements, wherein the inks or writing fluids tend to dry out.

It is therefore the principle object of this invention to provide a device which is capable of performing all of the aforesaid functions.

These and other objects are realized in accordance with the present invention which comprises, in preferred form, a rectangular pocket-sized caddy constructed to accommodate a plurality of writing implements in side-by-side parallel relation, the writing ends of which are snapped into sockets in the caddy which serves simultaneously to support and to securely cap each of the writing implements, eliminating loose caps which children may choke on.

The multicap caddy in accordance with the present invention comprises a hollow body of flexible plastic, which is integrally molded to include a plurality of aligned sockets into which the writing ends of the writing implements are each accommodated in a snap-fit.

In one embodiment, the caddy is structured to accommodate conventional marking devices equipped with caps, and retain the caps of individual writing implements in the sockets upon removal of the marking devices from the caddy.

A particular feature of this embodiment is that the inner profile of the caddy socket is so shaped that once the capped marking device is forcibly interposed into the interior of the socket, the cap is secured in place, and is not readily removed, when the marking device is removed.

In another embodiment, the caddy is formed with sockets which are designed to and function as multicaps for writing instruments.

In accordance with another modification, the caddies of the present invention are designed with interlocking modular attachments so that a plurality of caddies can be arranged in stacked relation on a desk or other working surface to accommodate a plurality of marking devices of different sizes and shapes.

As a further feature, a patch of self-gripping fastening material known by the trademark VELCRO may be applied to the rear wall of individual caddies, so that they can be fastened together, or removed from the work surface and secured to the page or cover of a three-ring notebook, or the interior of a carrying case.

It will be apparent that a pocket container designed in accordance with the present invention has many advantages over prior art writing implement containers, in that it is easy and convenient to carry and use, avoiding the loss or misplacements of caps, and is readily manufactured and assembled by simply snapping writing implements of various sizes into place in the caddy.

These, and other objects, features and advantages will be better understood from a study of the specification hereinafter with reference to the attached drawings.

SHORT DESCRIPTION OF THE DRAWINGS

DETAILED DESCRIPTION OF THE INVENTION

Figure 1:
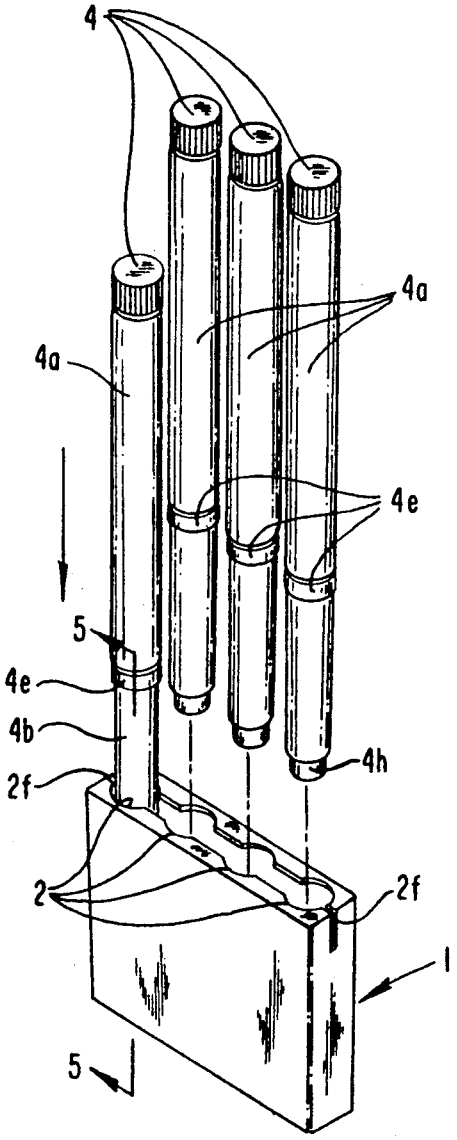
FIG. 1 shows one embodiment of a caddy in accordance with the present invention which is constructed to receive and capture the caps of conventional marking devices inserted therein. The marking devices are in the process of being inserted in the caddy.
Figure 2:
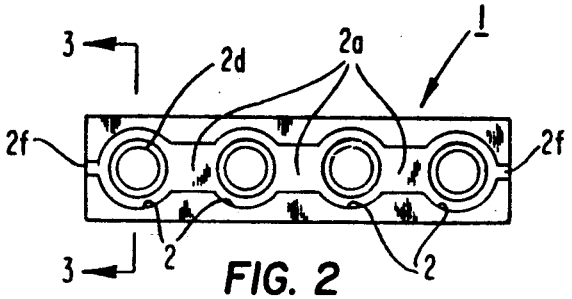
FIG. 2 shows a view of the top of the caddy of FIG. 1 before the caps are inserted.
Figure 3:
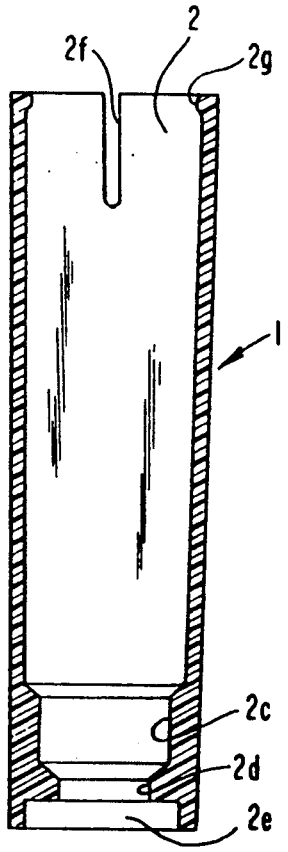
FIG. 3 is a sectional showing through the vertical plane marked by the arrows 3—3 of one of the sockets in the caddy of FIG. 1 before any pen bearing a cap has been inserted.

Referring in detail to FIG. 1 of the drawings, there is shown, in perspective, a pocket caddy 1 for writing implements, in accordance with the present invention, for use in the pocket or purse, or on the desk. In the present illustrative embodiment, this comprises a hollow rectangular container 1 formed of a flexible plastic material, such as, for example, polypropylene, or some other flexible or elastomeric material.

It will be understood that the caddy of the present invention may be designed to accommodate markers and writing implements of many different sizes and shapes.

The caddy 1, which is shown by way of example in FIG. 1, is designed to accommodate jumbo marking pens 4, say, 15 centimeters in overall length including the cap 4*b*. The body 4*a* of each has a diameter not exceeding say, 1 centimeter. The upper body portion is, say, 9 centimeters in axial length, and is stepped back about 1 millimeter in radial width forming a cylindrical holder 4*d*, say 8 millimeters in diameter, extending an additional 2 centimeters in axial length to an end cylinder 4*f* about ½ centimeter in diameter which extends about 6 millimeters beyond the end of 4*d*. The latter supports a marking tip 4*c*, extending a few millimeters beyond the end of holder 4*f*. A cap 4*b*, 1 centimeter in internal diameter and about 1.1 centimeters in outer diameter encloses the marking tip 4*c*. Cap 4*b* is about 4 centimeters in axial length, and is just accommodated on the holder 4*d*. Cap 4*b* has at its upper end an upwardly extending annular collar 4*e* which mates in sealed relation with a flange on the lower annular surface of the body 4*a*.

FIG. 1 shows four jumbo pens 4, one being interposed into semicylindrical socket 2 of the caddy 1.

In the present illustrative embodiment, the caddy 1, is designated to accommodate marking devices 4, which may be either jumbo size, as shown, or a more conventional smaller size. In the present embodiment, the caddy 1 is, say, 65 millimeters across the top, 45 millimeters deep, and 15 millimeters wide. It has four semicylindrical sockets which accommodate the jumbo marking devices 4 initially closed by their caps 4*b*.

Figure 4:
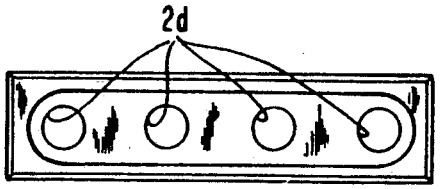
FIG. 4 is a bottom view of the caddy of FIG. 1.
Figure 5A:
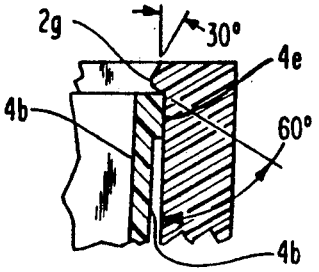
FIG. 5A shows in enlarged, fragmentary detail a part of FIG. 5.
Figure 5:
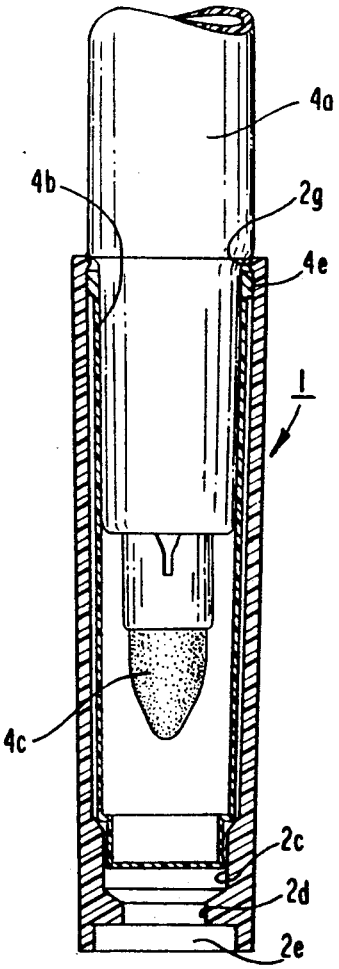
FIG. 5 is a section through the vertical plane 5—5 of FIG. 1 showing a pen snap-fitted into the caddy.

The semicylindrical sockets 2 extend about 4½ centimeters vertically at a slight inward taper, as shown in FIGS. 4 and 5. The diameter of the semicylindrical sockets 2 at the top is about 1.1 centimeters across, narrowing down to about 8 millimeters across at the bottom.

Figure 7:
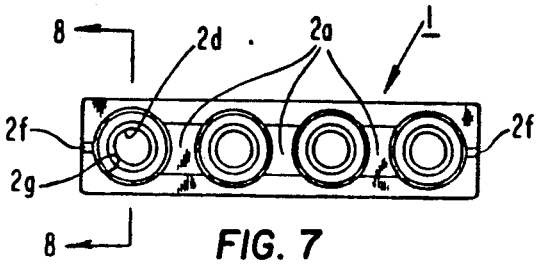
FIG. 7 is a view of the top of the caddy of FIG. 6, showing the marking devices removed and the caps retained after the marking devices have been removed.

FIG. 7 shows the top of the caddy 1. The semicylindrical sockets 2 are aligned with their centers spaced apart about 1.5 centimeters, the semicylindrical sockets 2 being interconnected by straight-walled openings 2*a* about 8 millimeters wide from internal front to back wall. These form a cut comprising sockets 2 separated by openings 2*a* which extends about 4½ centimeters deep, and terminates at opposite lateral ends in a pair of slits 2*f* extending down about 1 centimeter from the top, so that the width of the cut in caddy 1 expands flexibly.

The wall of the semicylindrical sockets 2 terminates at the lower end in an opening 2*c* of smaller diameter, which narrows into circular openings 2*d* which is designated to accommodate the flanges 4*h* on the caps 4 in a slight recess 2*e* on the bottom of the caddy 1. (See FIG. 4.)

FIG. 5 shows in partial section one of the marking device 4, together with its cap 4*b* initially snap-fitted into one of the semicircular sockets 2.

In accordance with a unique feature of the present invention, a cam-shaped flange 2*g* extends inwardly from the upper edge of each of the semicylindrical sockets 2, as shown in fragment in the detailed FIG. 5A. As shown in vertical section in FIG. 5A, the semiannular flange 2*g* forms an angle of 30 degrees with the axis of 2, as measured from above, the horizontal plane, and an angle of 60 degrees as measured from below the horizontal plane.

Figure 6:
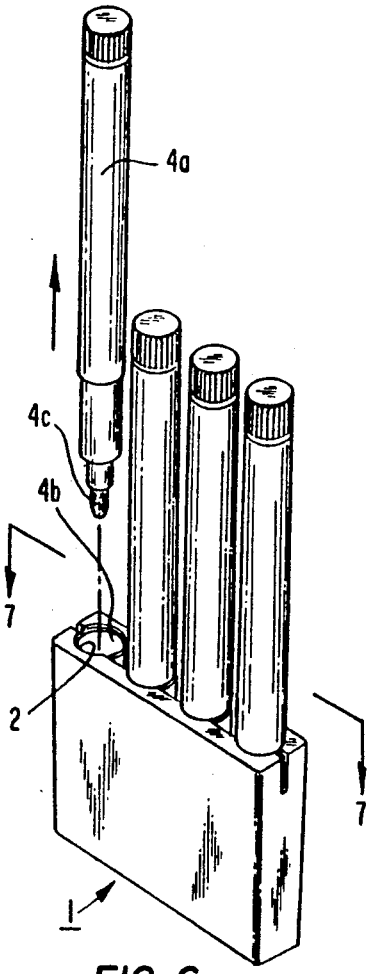
FIG. 6 is a view of the caddy of FIG. 1 with three marking devices in place, and with one of the marking devices being removed, while its cap is retained in the caddy.
Figure 8:
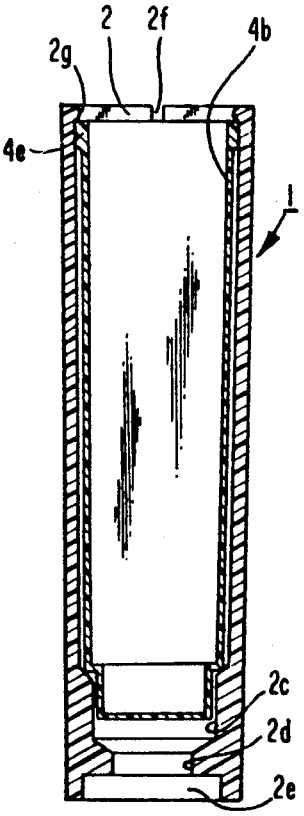
FIG. 8 is a sectional view of the caddy of FIG. 5 along a vertical plane indicated by the arrows 7—7 indicating the profile of one of the slots in which the cap has been retained.

When the marker 4 is snapped into place in one of the semicylindrical openings 2, as shown in FIG. 5, the lip 4*e* on cap 4*b* overrides the flange 2*g*, and snaps into place, so that the annular lip 4*e* is captured beneath the flange 2*g*. Thus, when the marking device 4 is removed from the caddy 1, as shown in FIG. 6, the cap 4*b* remains captive as shown in section in FIG. 8 with the lip 4*e* abutting the lower surface of cam-like flange 2*g*. FIG. 7 shows the top of the caddy 1 with the marking devices removed, but the caps 4*b* remaining in place beneath the cam-like flange 2*g*. Thus, the caddy 1 now functions as a multicap, placed on the desk or carried in the pocket, for accommodating the marking devices 4 whenever they are placed in the caddy.

Figure 9:
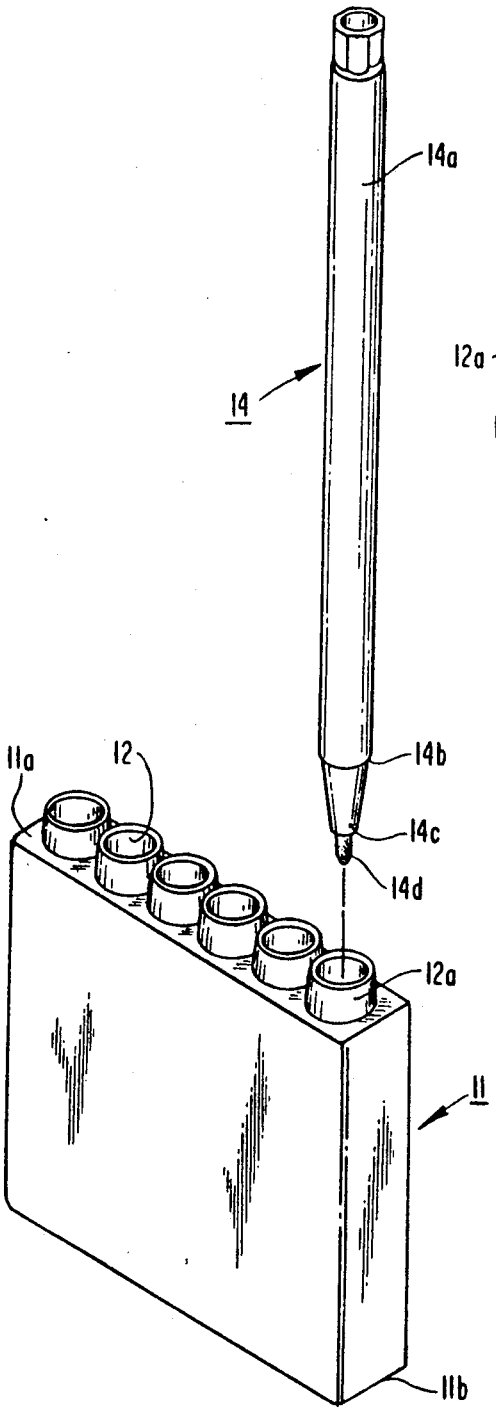
FIG. 9 shows a modification of the invention of FIGS. 1–7 in which the caddy provides stationary caps for any marking devices or writing implements inserted therein.
Figure 10:
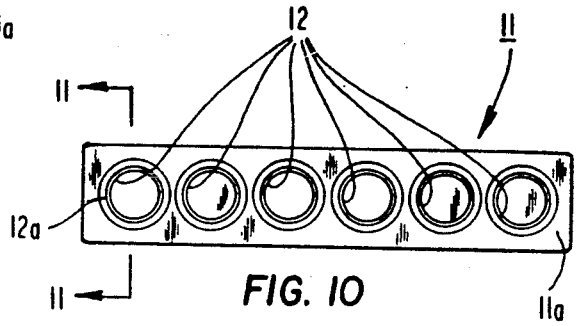
FIG. 10 is a top view of the caddy of FIG. 9.
Figure 11:
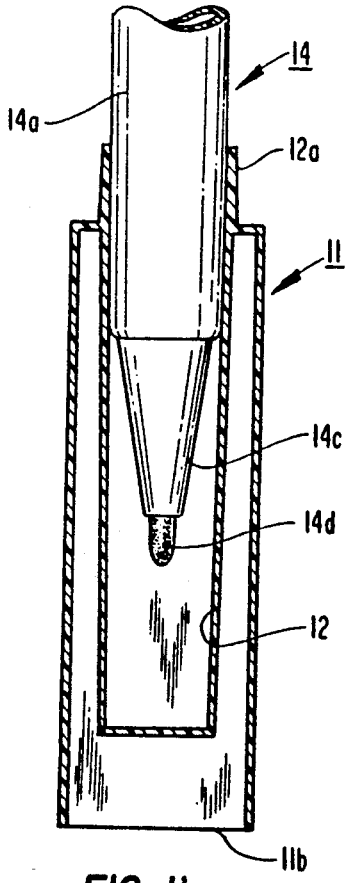
FIG. 11 is a sectional view along the vertical plane 11—11 of one of the retainer sockets of FIGS. 9 and 10 with a pen inserted.

A modification of the invention is shown in FIGS. 9, 10 and 11 in which the caddy 11 is designed to function as a multicap for a plurality of writing implements of conventional form which are purchased without caps.

FIG. 9 shows a marking device 14 being interposed into the modified caddy 11. The body portion 14*a* of the marking device is, say, 12 centimeters long, terminating at its lower end in a frustoconical holder 14*c* having a writing nib 14*d*, which extends, say one centimeter from the end of 14*a*. The diameter of the body 14*a* is about 6 millimeters.

The caddy 11, which is shown in perspective in FIG. 9 and plan view in FIG. 11, in the present embodiment is, say, 65 millimeters across the width, 45 millimeters deep, and 1½ centimeters across at the top, being stepped back to a width of about 13 millimeters across the bottom 11*b*.

The present embodiment has six cylindrical sockets 12, each, say, 6 millimeters in diameter. Mounted in coaxial flush relation with each of the sockets 12 is a collar 12*a* which projects, say, 3 millimeters above the surface, having a wall thickness of, say, 1 millimeter. The six sockets 12 and collars 12*a* are centered about 1 centimeter apart on the surface 11*a* of caddy 11. The sockets 12 and the collars 12*a* just exceed, say, 6 millimeters in inner diameter. Thus, the caddy 11 functions as a multicap for a plurality of marking devices 14, which are snap-fitted in place in closed sealed relation with the sockets 12, the bodies 14*a* sealing against the internal surface of 12, each forming a substantially airtight chamber for the ink-bearing nibs 14*d*.

Figure 13:
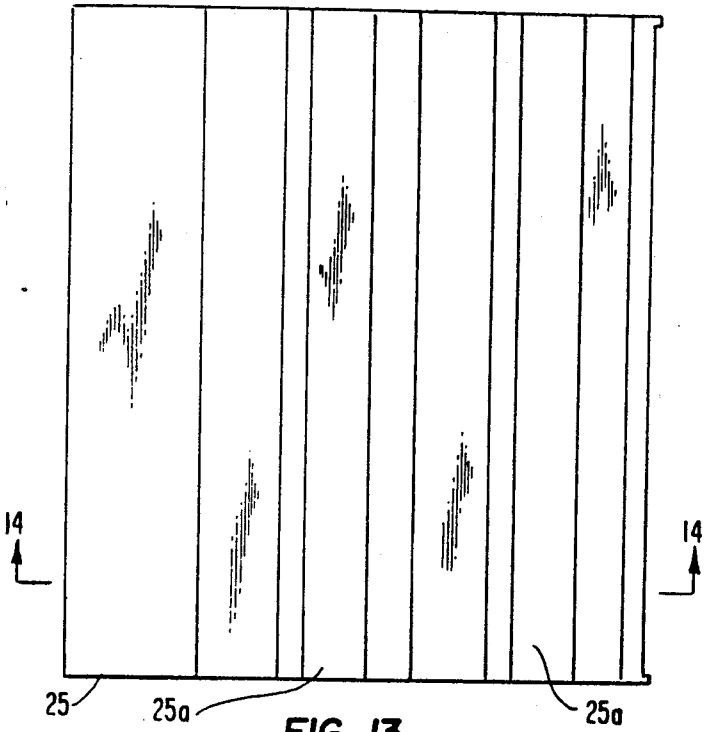
FIG. 13 is a plan view of the array of FIG. 12.
Figure 14:
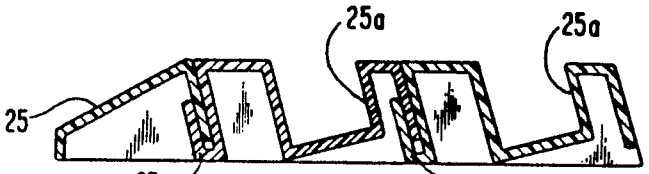
FIG. 14 is a sectional view through the vertical plane of the modular standard indicated by the arrows 14—14 of FIG. 13.
Figure 12:
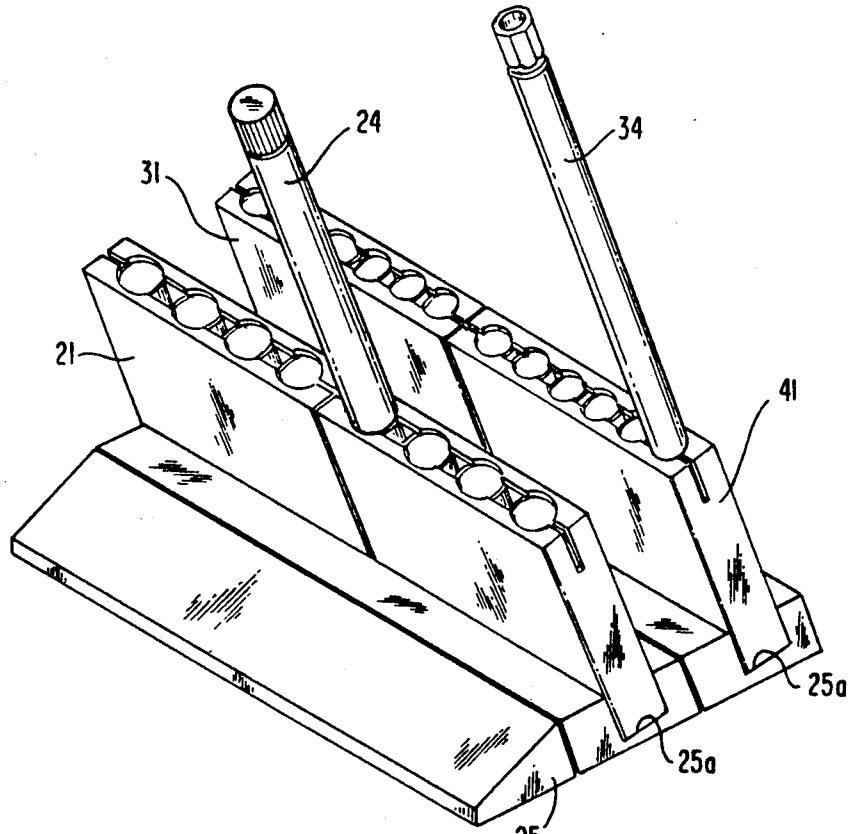
FIG. 12 shows in perspective another modification including an array of caddies of the previous figures in which several caddies are stacked together in a modular standard to provide a desk array.

Let us refer to another embodiment of the invention shown in perspective in FIG. 12, in plan view in FIG. 13, and in cross-section in FIG. 14. The detailed modules are shown in perspective in FIGS. 14A, 14B and 14C.

Assuming several caddies for different types of marking devices are acquired at once, it is desirable to provide a stand for stacking the caddies together on the writing surface, as shown in FIGS. 12 and 13.

Figure 14A:
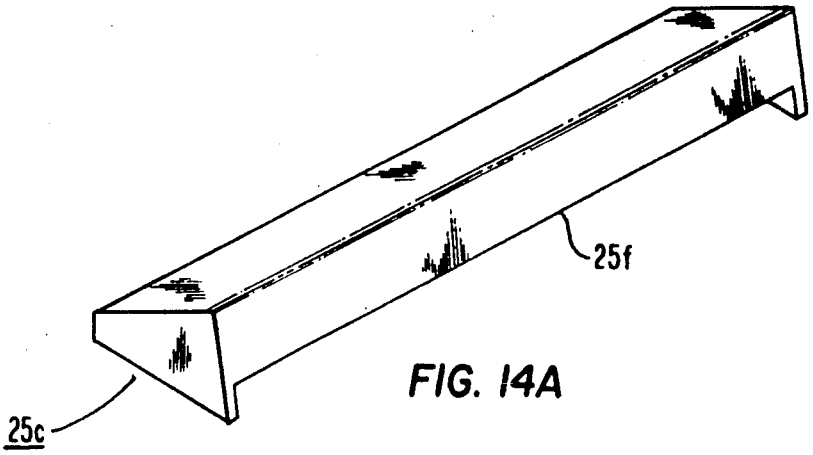
FIGS. 14A, 14B and 14C show in perspective components of the standard shown in FIG. 14.
Figure 14B:
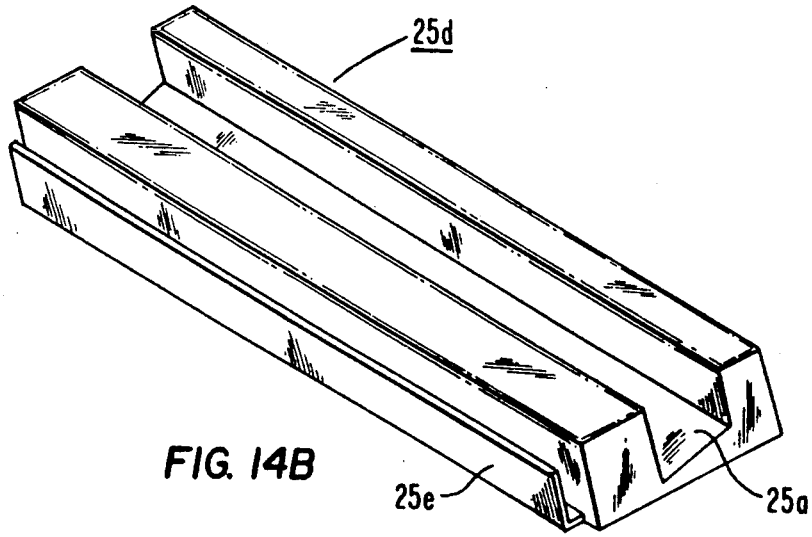
Figure 14C:
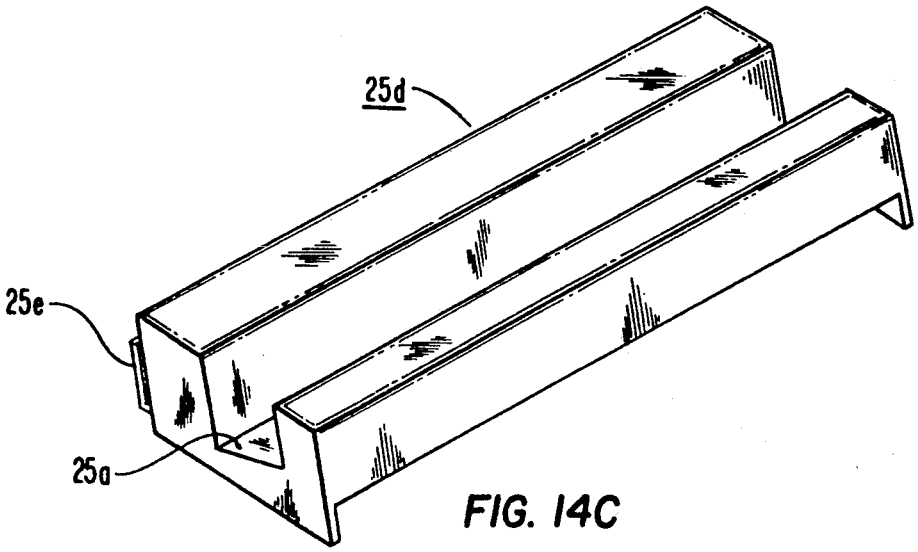
Figure 16:
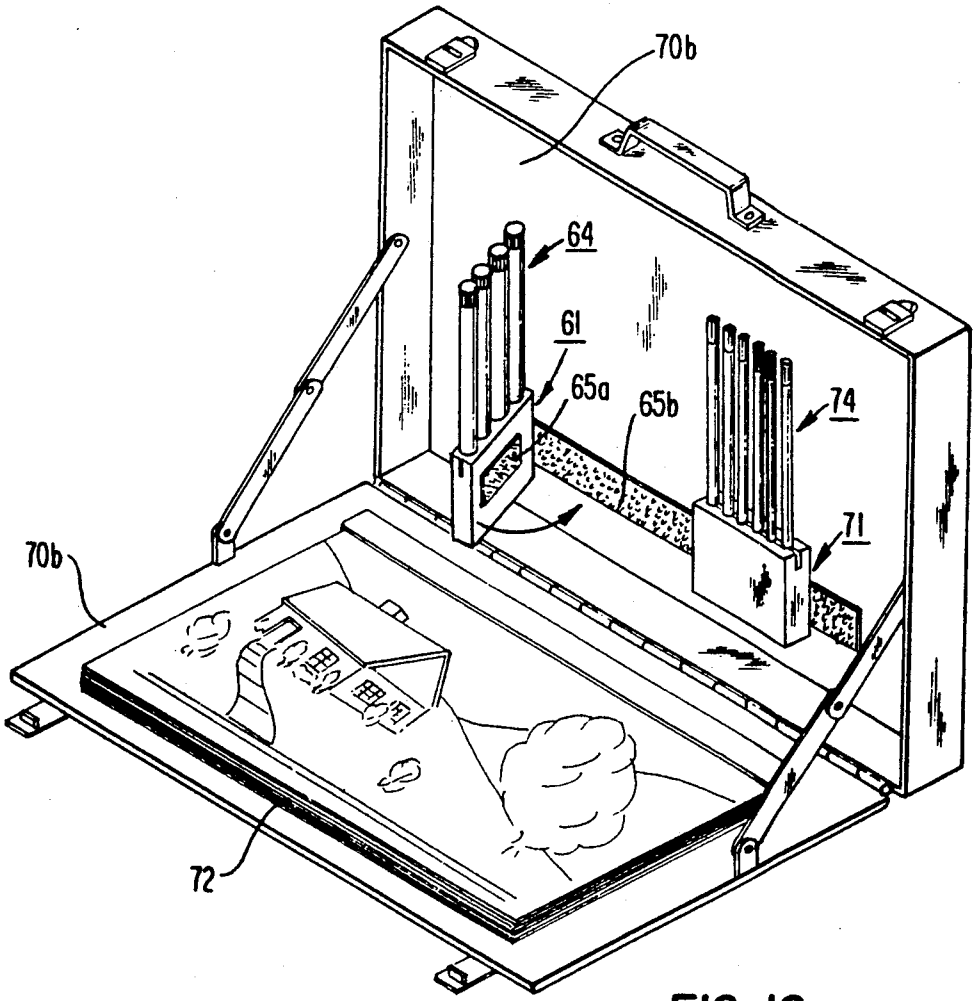
FIG. 16 shows a notebook or carrying case in accordance with the present invention in which one or more caddies carrying different types of marking devices is secured by VELCRO (brand) fastening material to the inside cover of the carrying case or notebook for optimum access by a children or student for use in coloring activities.

In accordance with the present invention, this is achieved by assembling in interlocked relation a series of modules 25 of wood or plastic as shown in section in FIG. 14, and in elongated perspective in FIGS. 14A (module 25*c*), 14B (module 25*d*) and 14C (module 25*d*), each of which is, say, 15 centimeters long.

When the module 25*c*, and the two modules 25*d* are hooked together by interposing the hook 25*e* on the front of each of the modules into the recess 25*f* at the rear of each of the modules, as shown in sectional view 14, a stand is created as shown in FIGS. 12 and 13. This provides a pair of elongated slots 25*a* just in excess of 1½ centimeters wide which accommodate the caddies 21 and 51 in one slot and 31 and 41 in a parallel slot, in upright position, making a convenient depository for marking devices of many different sizes. Such a combination can be assembled or disassembled readily, according to the convenience of the user, depending on how many pens or writing devices he wishes to have available for use.

Figure 15:
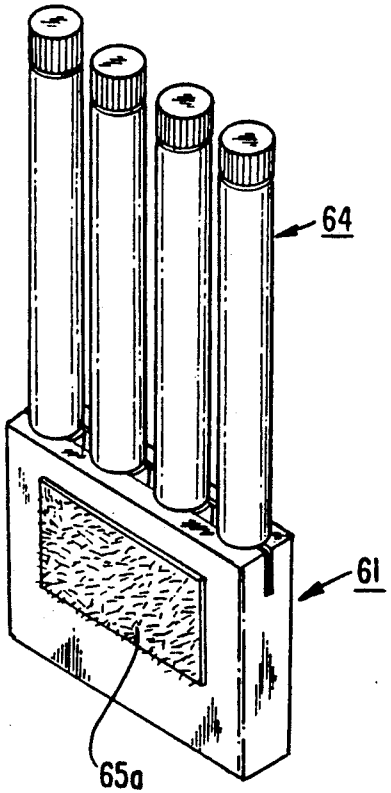
FIG. 15 shows a further modification of the caddy shown in FIGS. 1 et seq. in which a patch of VELCRO or similar self-gripping material is applied to the rear surface of the caddy.

Another modification is shown in FIG. 15 in which a caddy 61 of the general type described with reference to FIGS. 1–7 accommodates a plurality of marking devices 64, and to which a patch 65*a* of a self-gripping fastening material such as, for example, that sold under the registered trademark VELCRO (brand) by Velcro, U.S.A., Inc. of Manchester, N.H., is applied. This patch may be, for example, centered on one of the major sidewalls of caddy 61, and may be 2 centimeters in a vertical direction and 3 centimeters in a width direction.

This enables the caddy 61 to be removed from the desk and secured to the inside top cover 70*b* of a conventional carrying case 70 of any of the types well-known in the art. To further secure the caddy 61, or a similar caddy 74 to the top inner cover of carrying case 70, the inner surface 70*b* of carrying case 70 may have a matching patch 65*b* centered in one or more positions. The latter case may be used to carry a school-child's coloring pages 72, or artists' supplies. As an alternative to the carrying case 70 the caddies 61 and 71 may be secured in a similar manner to the inner cover of a ring-binder or notebook.

A particular advantage of the multicap of the present invention, is that it eliminates individual pen caps, preventing children from swallowing them.

The invention is not limited to any of the particular forms or materials disclosed herein by way of example but only by the scope of the appended claims. For example, the caddies 1, 11, 21, 31, 41, and 51 may be designed to accommodate pens, pencils and marking devices of all different sizes and shapes, which are snapped into place in sealed relation to the sockets in the multicap formed by the caddy. The material of which the caddies are formed may be any solid resilient, flexible or elastomeric material, such as polypropylene, or other similar plastics, hard rubber or the like.

What I claim is:

1. A caddy including writing implements each having a barrel terminating in a writing end including a writing nib for feeding writing fluid from a reservoir in said barrel;

said caddy comprising a hollow structure comprising a multicap having a body of flexible plastic material, said body having an upper surface and a lower supporting surface substantially parallel to said upper surface, a plurality of sockets extending in substantially parallel relation on said multicap from said upper surface in the direction of said lower surface, and shaped to retain in each of said sockets in captured relation a cap which is designated to snap-fit in sealed relation against the lower end of said barrel to retain each said writing nib in a substantially air-tight chamber when snap-fitted into said multicap.

2. A caddy in accordance with claim 1 for writing implements wherein each of said writing implements is initially equipped with a cap having a closed end and an open end with an annular edge which snap-fits onto the barrel of said implement for securing the writing nib in a substantially air-tight chamber when said cap is closed on said writing implement;

means in each socket of said caddy for accommodating each said cap when a respective one of said writing implements is snap-fitted into said socket, and for capturing each said cap in said socket when said respective writing implement is removed from said socket.

3. A caddy in accordance with claim 2 wherein said means for capturing each said cap comprises an inwardly directed cam-shaped flange adjacent the upper end of each said socket which is constructed and arranged to be overridden by the upper annular edge of a cap of a respective one of said writing implements when the same is interposed in snap-fitted relation into said socket, and wherein said flange is constructed and arranged to engage and retain the upper edge of said cap when said respective writing implement is removed from said caddy.

4. A caddy in accordance with claim 3 wherein said cam-shaped flange has cross-sectional shape in a plane normal to the principal axis of said socket which forms an angle of the order of 40 to 80 degrees with said axis in the exiting direction of said writing implement.

5. A caddy in accordance with claim 1 wherein said sockets are disposed in separate aligned relation terminating at each of their upper ends in a shallow annular collar having an inner diameter substantially equal to the inner diameter of said socket, each said shallow annular collar constructed to engage the body portion of a respective one of said writing instruments in substantially air-tight relation, thereby forming substantially air-tight multicap for a plurality of said writing instruments.

6. A caddy including writing implements each having a barrel terminating in a writing end including a writing nib for feeding writing fluid from a reservoir in said barrel;

said caddy comprising a hollow structure comprising a multicap having a body of flexible plastic material, said body having an upper surface and a lower supporting surface substantially parallel to said upper surface, a plurality of sockets extending in substantially parallel relation on said multicap from said upper surface in the direction of said lower surface, and shaped to retain in each of said sockets in captured relation a cap which is designated to snap-fit in sealed relation against the lower end of said barrel to retain each said writing nib in a substantially air-tight chamber when snap-fitted into said multicap;

wherein said sockets are aligned and each of said sockets is interconnected in a lateral direction forming a lengthwise cut along the upper surface of said caddy; and wherein said cut terminates on each of its lateral ends in a slit extending down from said upper surface, whereby the width of said cut relates flexibly to the diameter of writing implements inserted therein.

7. In combination with claim 1, a standard constructed and arranged to accommodate at least one caddy for a plurality of writing implements comprising a plurality of modules having elongated rectangular slots each of which is shaped to accommodate at least one said caddy in upright position;

each of said modules equipped with a substantially identical hook-like projection across the front surface and a recess across the rear surface which is constructed to mate with said hook-like projection, wherein any desired number of said modules are constructed to be fastened together to form a standard for accommodating any desired number of caddies.

8. In combination:

A caddy in accordance with claim 7 having a patch of a self-gripping material known by the trademark VELCRO fastened to one of its large flat lateral surfaces, a carrying device or supporting surface for writing implements including at least one patch of a matching self-griping material known by the trademark VELCRO, which is constructed to accommodate in mating relation at least one said caddy for carrying or supporting purposes.

* * * * *